US006457236B1

(12) United States Patent
White et al.

(10) Patent No.: US 6,457,236 B1
(45) Date of Patent: Oct. 1, 2002

(54) APPARATUS AND METHOD FOR RESTRICTING FLUID FLOW IN A PLANAR MANIFOLD

(75) Inventors: Richard P. White, Glen Mills, PA (US); Michael Q. Thompson, East Fallowfield, PA (US)

(73) Assignee: Agilent Technologies, Inc., Palo Alto, CA (US)

( * ) Notice: Subject to any disclaimer, the term of this patent is extended or adjusted under 35 U.S.C. 154(b) by 0 days.

(21) Appl. No.: 09/873,390

(22) Filed: Jun. 5, 2001

(51) Int. Cl.[7] ..... F16K 27/00

(52) U.S. Cl. ..... 29/890.08; 29/407.08; 138/40

(58) Field of Search ..... 29/890.08, 407.08, 29/709, 34 R, 283.5; 138/40

(56) References Cited

U.S. PATENT DOCUMENTS 3,572,558 A * 3/1971 Hooker ..... 138/40
3,995,356 A * 12/1976 Sheppard ..... 29/890.128
4,087,301 A * 5/1978 Steadman ..... 156/198
4,271,099 A * 6/1981 Kukla ..... 261/76
5,642,640 A * 7/1997 Insalaco et al. ..... 72/334

* cited by examiner

*Primary Examiner*—John Fox

(57) ABSTRACT

The present invention refers to a novel apparatus and method to restrict pneumatic flow in a planar manifold. A forming tool of specific geometry is pressed into a planar manifold causing the pneumatic channel inside to collapse onto itself in a predictable and controllable way, therefore restricting the fluid flow in the pneumatic channel. The geometry of the forming tool is provided with angles and radii so that the planar manifold is not ripped during the pressing operation. Further, the geometry limits the deformed area so that distortion of adjacent pneumatic channels, and the potential for springing leaks between layers is minimized. In a preferred embodiment, the tooling also provides flow measurement while the forming tool is pressed into the planar manifold at a specific orientation.

20 Claims, 8 Drawing Sheets

APPARATUS AND METHOD FOR RESTRICTING FLUID FLOW IN A PLANAR MANIFOLD

FIELD OF INVENTION

The present invention relates to methods and apparatus for controlling a fluid stream in a pneumatic assembly.

BACKGROUND OF THE INVENTION

Modem analytical instrumentation, such as a gas or liquid chromatograph, often requires accurate control of a fluid stream. Such instruments can employ one or more fluid streams in respective flow paths, and an extensive and complex array of channels, tubing, and fittings that are necessary for controlling the fluid flow. In addition, there is often a need to sense certain characteristics of the fluid at different points in the flow paths, such as the pressure, flow rate, and temperature of the fluid. These needs are typically addressed by the attachment of different sensors to the flow path, further increasing the complexity and physical volume of the flow system.

Diffusion bonded planar manifold technology offers a solution that simplifies the flow system. By eliminating the connecting tubing and fittings between different components, diffusion bonded planar manifolds provide a flow system that is compact, easily-manufactured, and reliable. A further advantage of diffusion bonded planar manifolds is that multiple fluid-handling functional devices may be coordinated and assembled in a small volume. This advantage results from pneumatic channels which are integrated into the diffusion bonded planar manifold, and which provide the fluid flow paths. The diffusion bonded planar manifold is also quite compact and amenable to construction in a variety of shapes and configurations, helping to minimize the volume of the flow system. However, the different flow paths in a diffusion bonded planar manifold often have balanced, or different flow rates which need to be controlled precisely for optimal performance of the instrument.

Commonly used devices for restricting fluid flow rates include discrete flow restrictors and fine bore tubing. Flow restrictors ("frits") are made of powder metals that are pressed or sintered into various porosity and shapes to provide the required pneumatic resistance. FIG. 1 shows a schematic representation of a porous metal frit in a pipe. The fluid flow enters at a high pressure and leaves at a lower pressure due to the pressure drop created across the frit element.

Flow restrictors are provided in holders, which are usually installed with elastomer seals. Alternately, flow restrictors are provided in various geometries that can be pressed into an assembly. In either case, flow restrictors are a separate part and require machined features, seals and/or fastening hardware to install. It is difficult to integrate flow restrictors into a thin diffusion bonded planar manifold without external seals or fastening hardware.

Fine bore tubing is available with thicker walls to provide small internal diameters and therefore pneumatic resistance if a long enough length is used. Fluid pressure drops as a function of fluid velocity and properties, tubing diameter and length, and friction due to pipe finish, fittings, and diameter changes. However, fine bore tubing also requires fastening hardware to install, and the size of tubing is usually larger than all the other features on a diffusion bonded planar manifold.

An alternative method to restrict flow is to reduce channel sizes in a diffusion bonded planar manifold. Restrictance by channel width (diameter) on diffusion bonded manifold plates, however, is limited by the etching and plating dimensions and the raw stock thickness. To date, pneumatic channels in diffusion bonded planar manifolds have been enlarged in size to provide more flow, but not decreased in size to restrict flow, because metal sheets with very small diameter channels are difficult to handle and prone to plugging during the bonding process.

SUMMARY OF THE INVENTION

The present invention provides a method and an apparatus to restrict flow rate in a diffusion bonded planar manifold with multiple, adjacent pneumatic channels. A forming pen with a bit is pressed into a diffusion bonded planar manifold causing the pneumatic channel inside to collapse onto itself in a predictable and controllable way. The bit has a geometry with angles and radii chosen or designed so that the surface of the diffusion bonded plate is dimpled but not ripped during the pressing operation. Further, the geometry of the bit limits the deformed area so that distortion of adjacent pneumatic channels is minimized, and the integrity of the deformed pneumatic channel and adjacent pneumatic channels is maintained (e.g., the pneumatic channels do not leak). No external seals or extra parts are required.

In a preferred embodiment, the apparatus also provides holding devices for the forming pen and/or the diffusion bonded planar manifold, as well as a pressing device to better control the pressure applied to the forming pen. In yet another preferred embodiment, the diffusion bonded planar manifold is connected to a regulated air supply and a flow meter so that the flow rate in the targeted pneumatic channel is monitored while the forming pen is pressed into the diffusion bonded planar manifold at a specific orientation. The method and apparatus disclosed herein may also be utilized to restrict flow rate in other types of planar manifolds, so long as they have a material property that allows plastic deformation without tearing or too much elastic springback.

These and other advantages will become obvious to those skilled in the art upon review of the following description, the attached drawings and appended claims. Although a preferred embodiment of the present invention and its advantages have been described in detail, it should be understood that various changes, substitutions and alterations can be made herein without departing from the spirit and scope of the invention as defined by the appended claims and their equivalents.

DETAILED DESCRIPTION OF THE PREFERRED EMBODIMENTS

Figure 1:
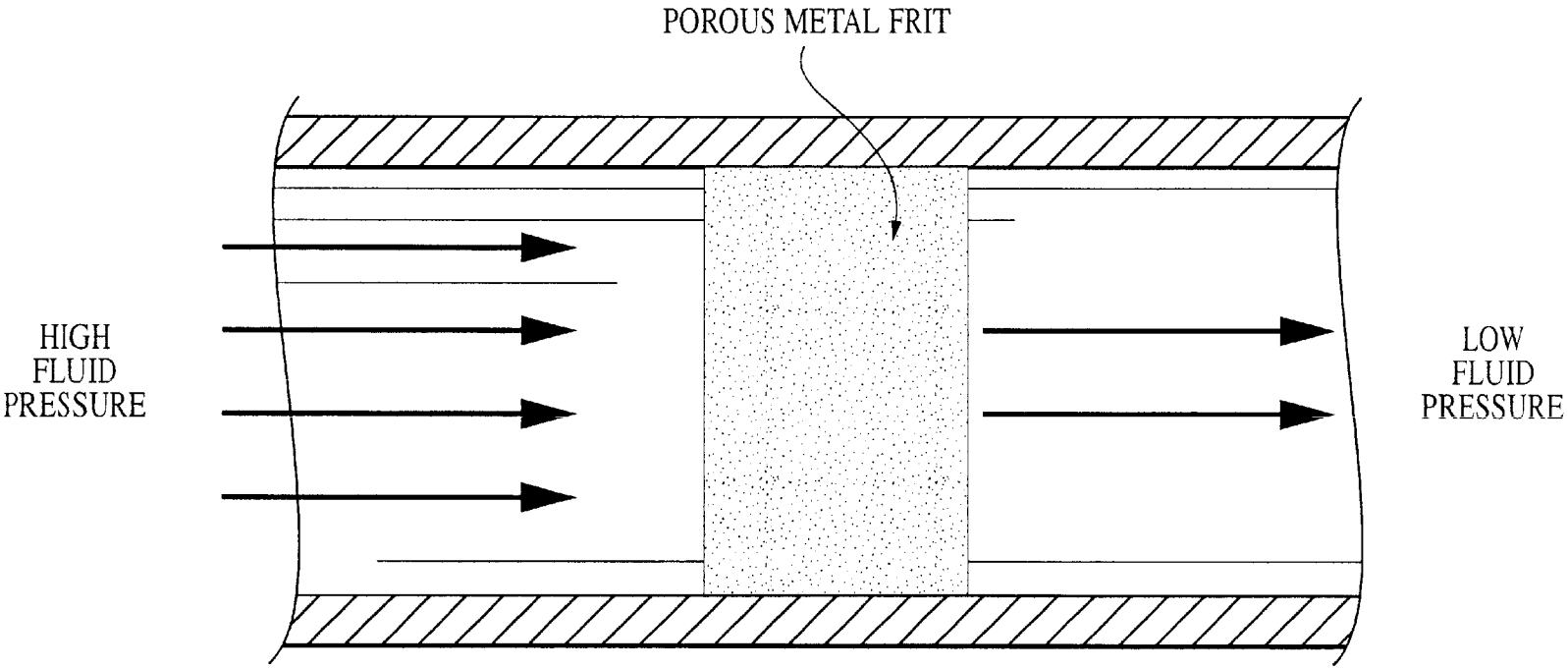
FIG. 1 shows a prior art method of restricting flow rate by a flow restrictor.

FIGS. 2*a*–2*e* show a forming pen 200 comprising a shank 202 and a bit 204. The forming pen's length (L) is usually greater than its width (W). Preferably, the length L may be in the range of about 15 mm to about 60 mm, and the width may be in the range of about 3 mm to about 8 mm. The bit 204 may be formed on one end of the shank 202. Alternatively, the bit 204 may be made of a material different from the shank 202 and may be attached to one of the ends of the shank 202. The bit 204 has one or more side surfaces 206 tapered inward with tapering angles θ varying from about 0° to about 75°, and preferably from about 30° to about 55°, relative to the longitudinal axis of the shank 202. The tapered side surface(s) 206 ends at a tip 208, which is preferably perpendicular to the longitudinal axis of the shank 202. The bit 204 may be made of any material of suitable hardness greater than the hardness of the material that constitutes the targeted area on the diffusion bonded planar manifold (not shown). The bit 204 is designed with such a geometry (i.e., the size and shape of the tip 208, and the tapering angles θ of the side surface(s) 206) so that the surface of the diffusion bonded planar manifold is dimpled but not ripped during the deforming operation. Further, the geometry limits the deformed area so that distortion of adjacent pneumatic channels, and the potential for springing leaks between the bonded layers or between pneumatic channels of the diffusion bonded planar manifold, is minimized.

Figure 2A:
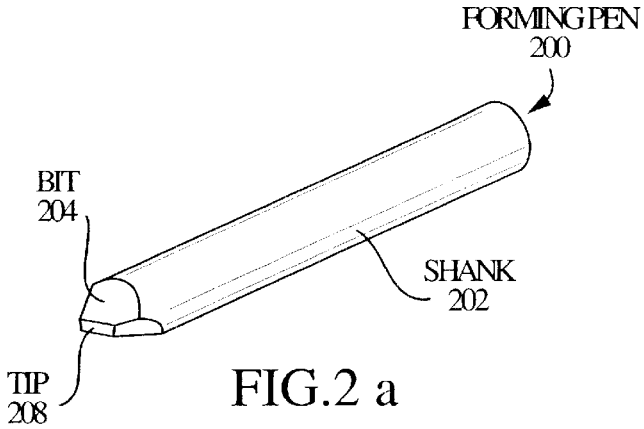
FIGS. 2*a*–2*e* show a preferred embodiment of a forming pen.
Figure 2B:
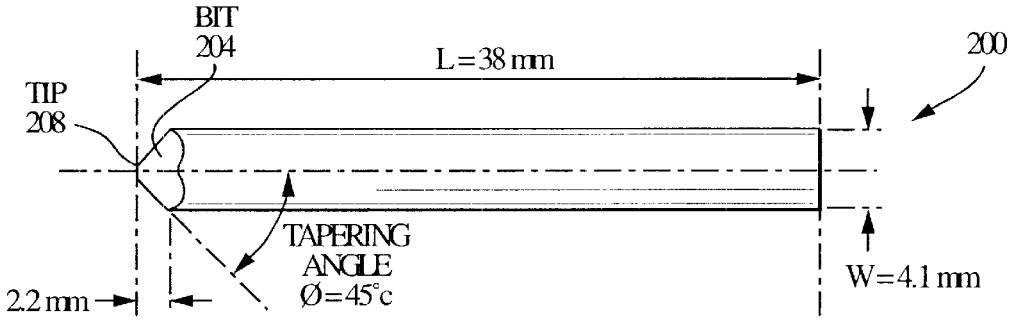
Figure 2C:
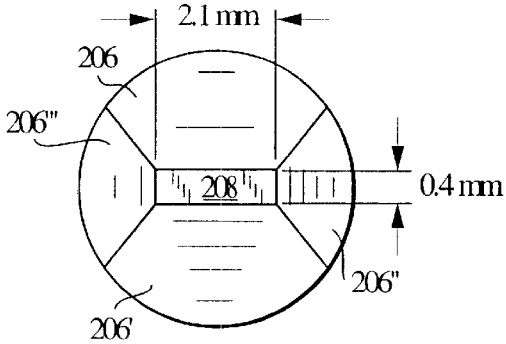
Figure 2D:
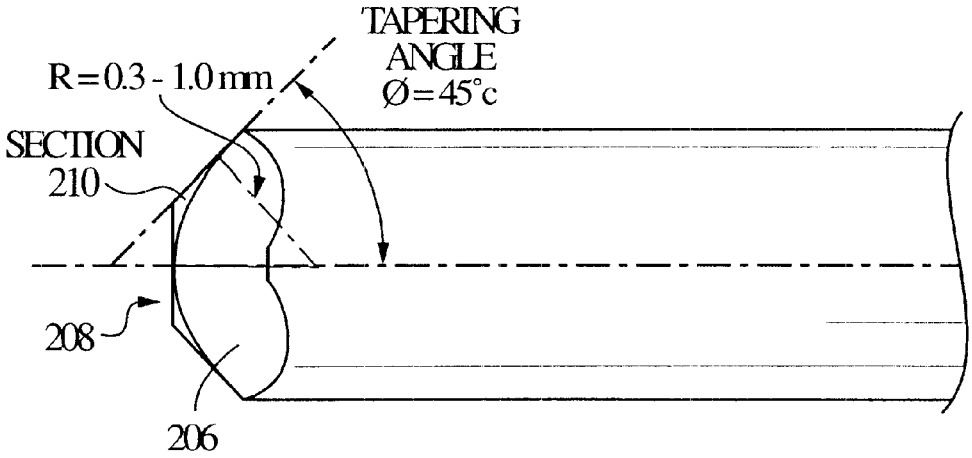
Figure 2E:
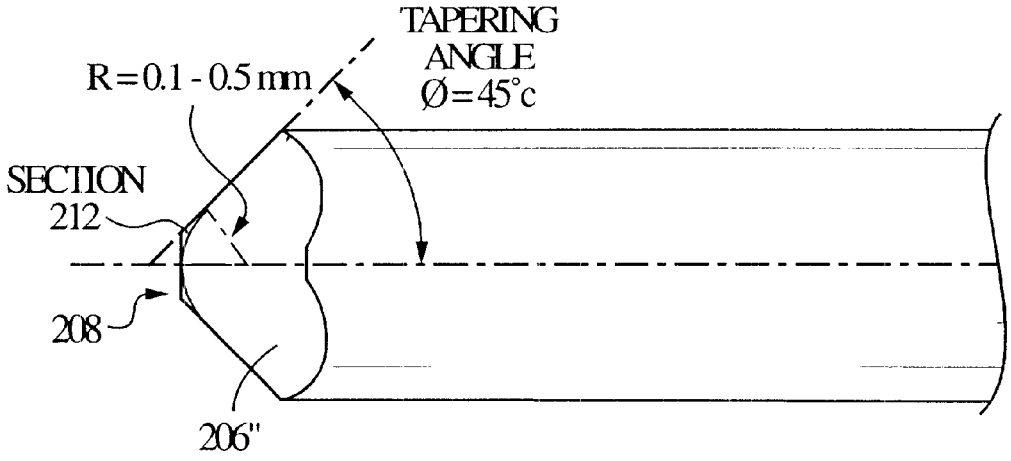

In the embodiment shown in FIG. 2*a*, the forming pen 200 is made of stainless steel. The forming pen 200 has a rod-like shank 202 and a bit 204 which is formed from the shank 202 at one end. As shown in FIGS. 2*b* and 2*c*, the length L of the forming pen 200 is about 38 mm and the width W (in this case the diameter) of the forming pen 200 is about 4.1 mm. The bit 204 is about 2.2 mm long and has four side surfaces. Side surfaces 206, 206', 206", and 206'" taper inward with a tapering angle of about 45° and end at tip 208, which has a nominally rectangular shape of about 0.4 mm (between surfaces 206 and 206') by 2.1 mm (between surfaces 206" and 206'"). All edges joining surfaces 206 and 208 are preferably smooth transitions of radius up to 1 mm in order to minimize tearing or scratching of the diffusion bonded plate during deformation. The smooth transitions may be made by polishing off edge sections 210 (FIG. 2*d*) and 212 (FIG. 2*e*) of the bit 204.

When the bit 204 of the forming pen 200 is pressed against the surface of a diffusion bonded planar manifold at a targeted pneumatic channel, the bit 204 deforms the surface and causes the targeted pneumatic channel under the surface to collapse onto itself, thereby restricting the fluid flow inside the targeted pneumatic channel. A holding device may be used to place the forming pen 200 at a desired position and with a desired angle relative to the diffusion bonded planar manifold. If the position of the area to be operated upon (i.e., the area where the targeted pneumatic channel is located) is not marked on the outer surface of the diffusion bonded planar manifold, specially designed holding tools may be needed in order to orientate the forming pen 200 to the targeted area on the diffusion bonded planar manifold. A pressing device, such as an arbor press, may be used to apply a controllable and measurable force to the forming pen 200. In a preferred embodiment, a regulated air supply and a flow meter are connected to the diffusion bonded planar manifold so that the flow rate in the targeted pneumatic channel is monitored during the deforming process. In this setting, the force applied to the forming pen 200 may be adjusted based on the flow rate so as to prevent over-restriction of the targeted pneumatic channel in the diffusion bonded planar manifold.

Figure 3:
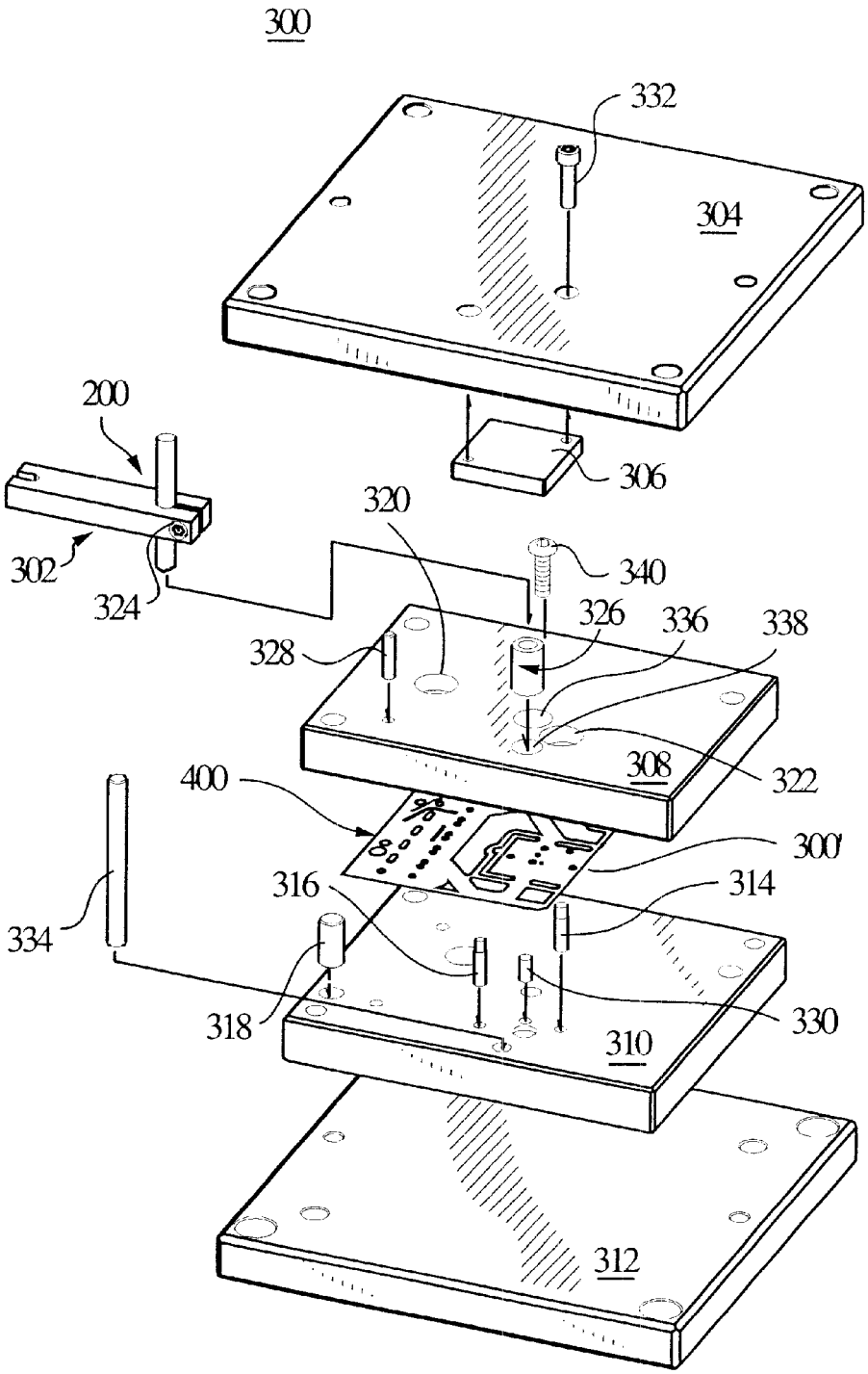
FIG. 3 is a side perspective view of a deforming apparatus.

FIG. 3 shows a deforming apparatus 300 that includes a forming pen 200 and a holding device 300 comprising a pen holder 302, a top plate 304, a upper stop 306, a top compression block 308, a bottom compression block 310, and a base plate 312. The top compression block 308 and the bottom compression block 310 hold registration pins 314 and 316, dowels 318 and seals (not shown) for a precise alignment of the compression blocks 308, 310 with the diffusion bonded planar manifold 400, which is sandwiched between the compression blocks 308 and 310. A number of o-rings (not shown) in various pockets on the bottom surface of the top compression block 308 and on the top surface of the bottom compression block 310 create seals to the targeted pneumatic channel in the diffusion bonded planar manifold 400. A cap screw 340 goes through a hole 336 to fasten the top compression block 308, the diffusion bonded planar manifold 400, and the bottom compression block 310 together. The top compression block 308 also provides an inlet port 320 for the connection to an air supply (not shown) and an outlet port 322 for the connection to a flow meter (not shown). The pen holder 302 clamps the forming pen 200 in a fixed orientation. A clamp screw 324 closes the split collar at the end of the pen holder 302 to lock orientation of the forming pen 200. The bit 204 of the forming pen 200 is placed in a hole 338 on the top compression block 308. A bushing 326 provides further alignment and orientation for the forming pen 200 relative to the top compression block 308. Preferably, the longer side of the tip 208 (i.e., the side where the surface 206 meets the tip 208, FIG. 2*c*) is aligned to a centerline of the targeted pneumatic channel. The pen holder 302 itself is oriented by a pen holder alignment dowel 328. A button 330 provides a hardened surface for the forming pen 200 at the bottom. The deforming of the diffusion bonded planar manifold can be performed manually by applying force to the upper end of the forming pen 200 with an arbor press (not shown) on the partially assembled deforming apparatus 300', which comprises the forming pen 200, the pen holder 302, the top compression block 308, the bottom compression block 310, and the diffusion bonded planar manifold 400.

Alternatively, the deforming process can be performed by a standard pneumatic dieset press (not shown) using the deforming apparatus 300. In this case the upper stop 306 is placed on top of the forming pen 200 to provide a hardened surface. The top plate 304 and the base plate 312 facilitate holding of the partially assembled deforming apparatus 300' by a standard press (not shown). The upper stop 306 is fastened to the top plate 304 by screws 332. A threaded stop 334 provides experimental hard stop for experimental fixed deflection evaluation.

Figure 4:
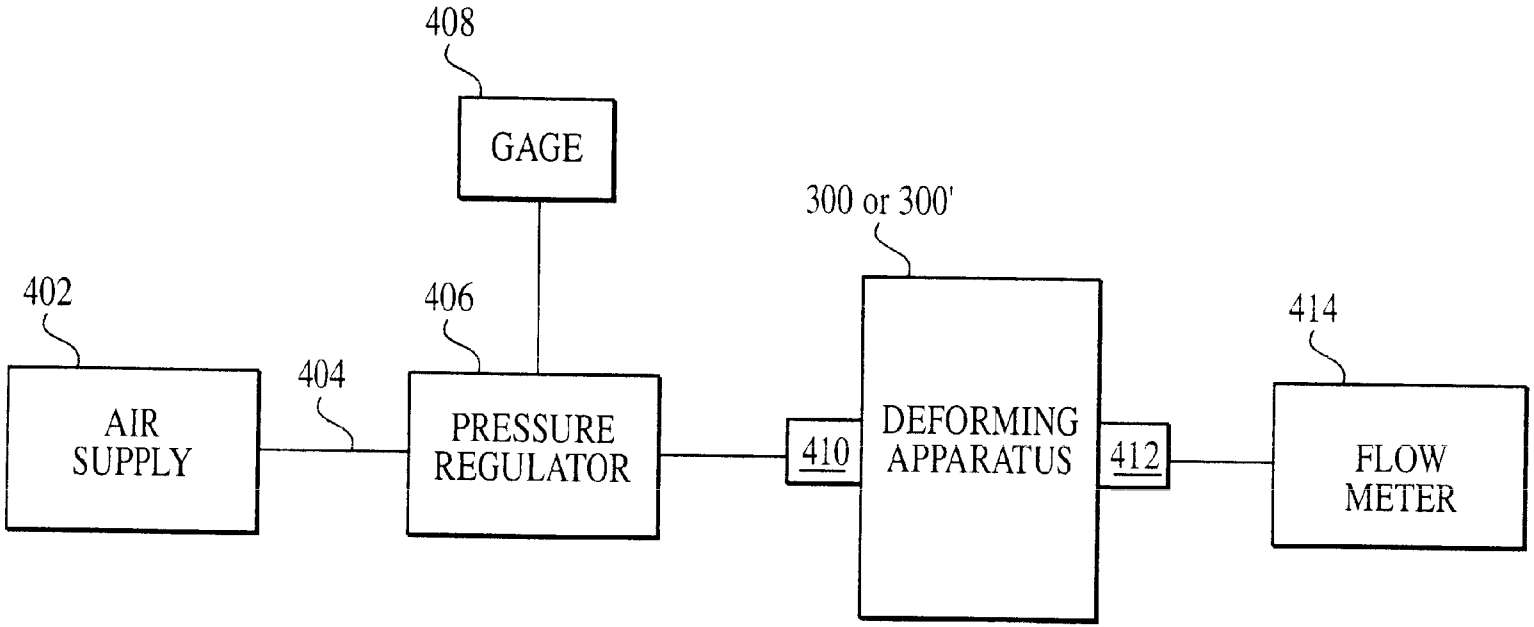
FIG. 4 is a block diagram of a deforming apparatus with an air supply and a flow meter.

FIG. 4 is a block diagram of a deforming apparatus with an air supply and a flow meter. From the air supply 402, a tube 404 leads to a pressure regulator 406 with an attached gage 408 that regulates the pressure to a desired range, for example, 5–10 psi. In a preferred embodiment, 6 psi was chosen to keep the before and after flow rates within the dynamic range (1–1000 ml/min) of the flow meter. The outlet of the pressure regulator 406 is connected to the deforming apparatus 300 or the partially assembled deforming apparatus 300' through an inlet fitting 410 which is fastened to the inlet port 320 (not shown in FIG. 4). A flow meter 414 is connected to the deforming apparatus 300 or the partially assembled deforming apparatus 300' through an outlet fitting 412 which is fastened to the outlet port 322 (not shown in FIG. 4).

A pressured air from the air supply 402 is fed through the tube 404 and the pressure regulator 406, through the inlet fitting 410 and the inlet port 320 on the top compression block 308, through the o-rings making a seal between the diffusion bonded planar manifold 400 and the top compression block 308, through the pneumatic channel being operated upon, and through another o-rings between the diffusion bonded planar manifold 400 and the top compression block 308 to the outlet port 322, and finally reaches the flow meter 414 through the outlet fitting 412.

Figure 5:
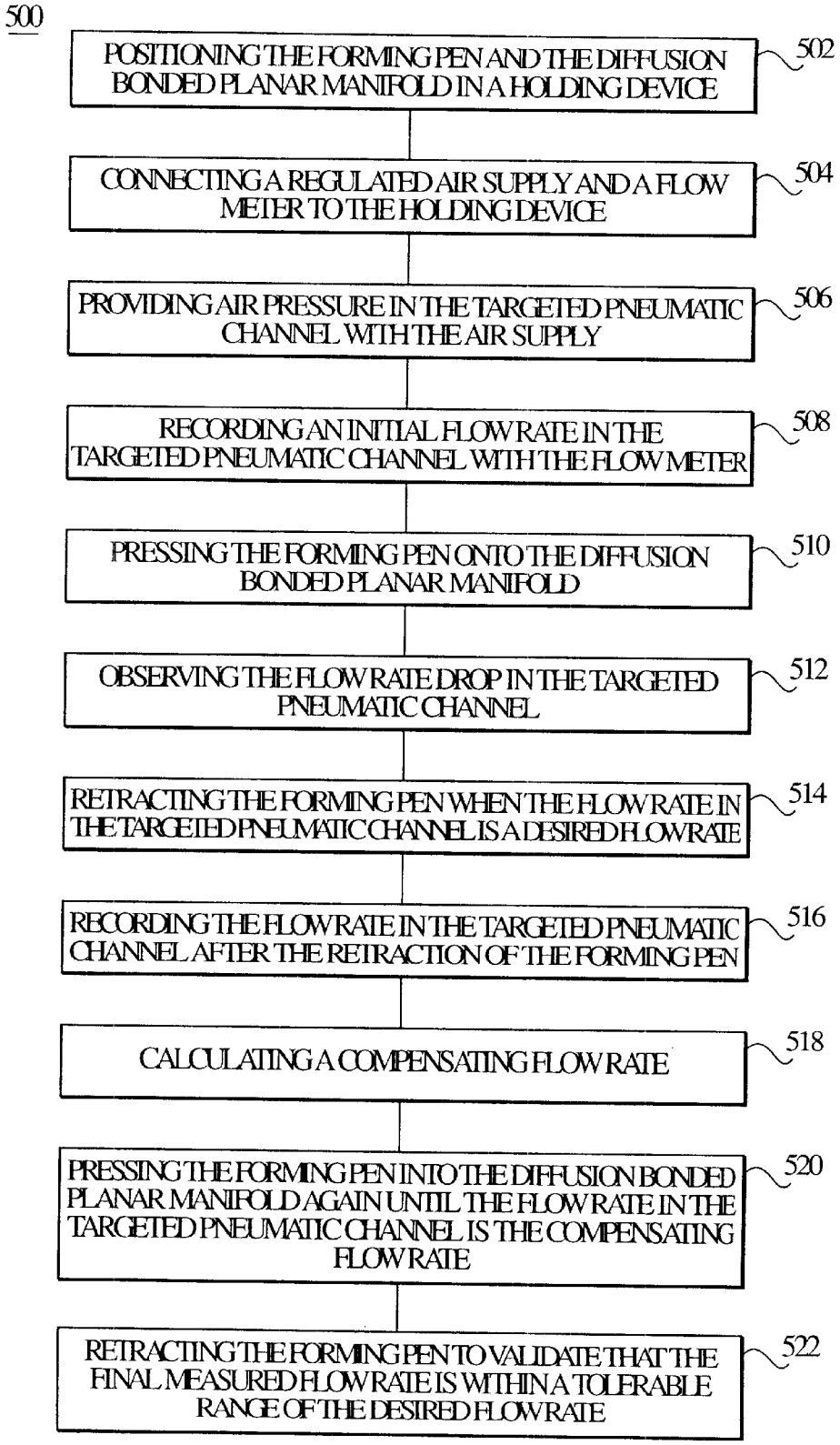
FIG. 5 is a flow chart showing the deforming process.

FIG. 5 illustrates an embodiment of a method 500 used to restrict the flow rate in a pneumatic channel of a diffusion bonded planar manifold. The method 500 preferably comprises the following steps: positioning 502 the forming pen and the diffusion bonded planar manifold in a holding device, connecting 504 a regulated air supply and a flow meter to the holding device, providing 506 an air pressure in the targeted pneumatic channel with the air supply, recording 508 an initial flow rate in the targeted pneumatic channel with the flow meter, pressing 510 the forming pen into the diffusion bonded planar manifold, observing 512 the flow rate drop in the targeted pneumatic channel, retracting 514 the forming pen when the flow rate in the targeted pneumatic channel is a desired flow rate, recording 516 the flow rate in the targeted pneumatic channel after the retraction of the forming pen, calculating 518 a springback differential flow and a compensating flow rate by the following formula:

Springback differential flow=recorded flow rate−desired flow rate,

Compensating flow rate=desired flow rate−springback differential flow, pressing 520 the forming pen into the diffusion bonded planar manifold again until the flow rate in the targeted pneumatic channel is the compensating flow rate, and retracting 522 the forming pen to validate that the final measured flow rate is within a tolerable range of the desired flow rate.

EXAMPLE 1

Restricting Flow Rate in a Branch of the Electronic Pressure Control (EPC) in a Micro-GC Manifold This example demonstrates how a partially assembled deforming apparatus 300' is used to restrict flow rate in a diffusion bonded planar manifold 400.

Figure 6:
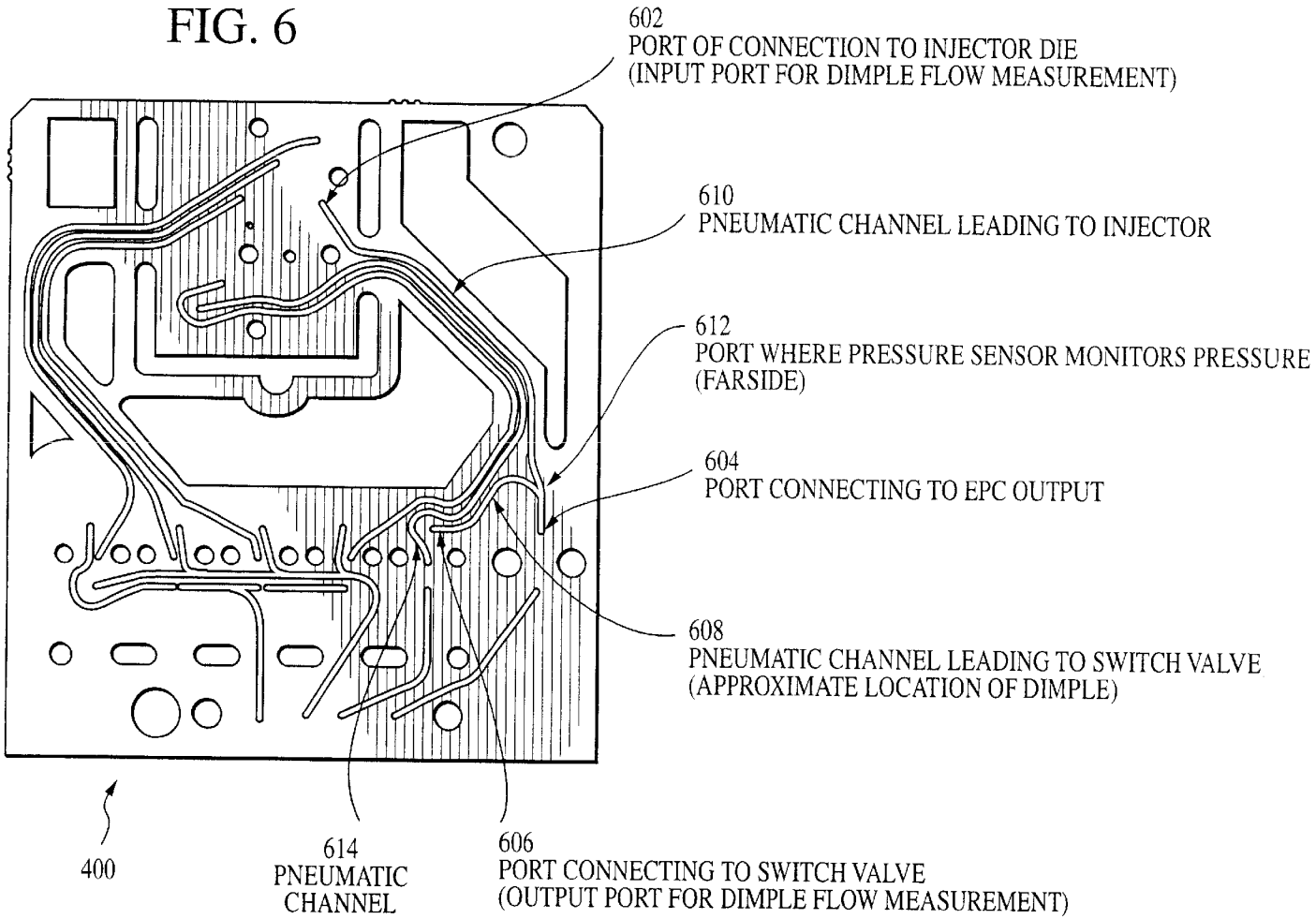
FIG. 6 is a front view of the interior side of a diffusion bonded planar manifold.

FIG. 6 shows the interior side of a diffusion bonded planar manifold 400. There are numerous pneumatic channels within the diffusion bonded planar manifold 400. A pneumatic channel 610 connects the EPC output port 604 to a pressure sensor port 612, to an injector die port 602, and to a switch valve port 606 through a merging pneumatic channel 608. The pneumatic channel 610 provides column flow to both reference and analytic columns on the injector die through port 602. Pneumatic channels 608 and 610 merge at the pressure sensor port 612 which is used for control feedback taps. The pneumatic channel that needs to be restricted (i.e., the targeted pneumatic channel) is pneumatic channel 608, and the approximate location of the dimple for restricting the pneumatic channel 608 is pointed to by arrow 608.

The reason for the channel restriction is to achieve stability of the EPC (not shown in the figure), and to provide a stable baseline for the micro GC. During the injection process, the total column flow is approximately 4 ml/min, provided by perhaps 25 psi of pressure from port 606 to port 602. At one point, the switch valve changes state and shares the EPC pressure through port 606 to perform an injector process, which creates a momentary high demand for carrier gas from EPC. This sudden drop in pressure causes the EPC to go out of control, causing undesired flow disturbance on the baseline output of the GC.

By limiting the flow to the switch valve (through pneumatic channel 608), the EPC can follow the temporary demand without introducing too much pressure noise on the primary column flow pneumatic channel 610 of the diffusion bonded planar manifold 400. The objective is to reduce the air flow rate in the pneumatic channel 608 from 600–700 ml/min to about 55 ml/min at 6 psi. This rate restriction creates a smoother transition during compression, lower demand on an EPC control loop, and a smoother baseline on the GC output chromatogram.

Since the pneumatic channel 608 is connected to four ports 602, 604, 606 and 612, ports 604 and 612 are sealed. Ports 602 and 606 serve as the inlet and outlet, respectively, for a flow measurement. As shown in FIG. 6, pneumatic channel 608 is in close proximity to another pneumatic channel 614. Therefore, the deformed area has to be limited to the extent that the flow rate in the neighboring pneumatic channel 614 is not affected. Furthermore, the deformed area has to be limited to the extent that the seals made against the diffusion bonded planar manifold 400 by devices attached at ports 606, 608, or 612 are not compromised by changes in surface finish or flatness. The deforming apparatus 300 in FIG. 3, which is specially designed for the diffusion bonded planar manifold 400, positions the forming pen 200 at the middle point between the pressure sensor port 612 and the switch valve port 606. The tip 208 is in close proximity and parallel to the surface of the manifold 400, with the longer side of the tip 208 aligned to the centerline of the targeted pneumatic channel 608.

The deforming process is performed with the following steps with references to FIG. 3:

1. Loading the tool:

Open the partial holding device 300' (without the diffusion bonded planar manifold 400) using a hex key on the clamp screw 340, remove the top compression block 308 by sliding the top compression block 308 straight up, and make sure that the o-rings (not shown in the figures) stay in place.

Put the diffusion bonded planar manifold 400 over the dowels 318 so that the diffusion bonded planar manifold 400 is properly positioned on the bottom compression block 310. Replace the top compression block 308 over the locating dowels without disturbing the location of the diffusion bonded planar manifold 400. Replace and tighten the cap screw 340.

Connect the pressure regulator 406 to the inlet port 320 through the inlet fitting 410, connect the flow meter 414 to the outlet port 322 through the outlet fitting 412.

Place the forming pin 200 into the hole 338 near the cap screw 340 and locate the partial assembly 300' under the arbor for deforming.

2. Pressing the dimple:

Turn on the air supply and see that the pressure is about 6 psi. Turn on the flow meter 414 and observe the flow rate. The flow rate is typically 600 to 800 ml/min of air.

Begin pressing the forming pin 200 with the arbor press and observe the flow rate falling on the flow meter 414. As the flow rate displayed on the flow meter 414 falls under 100 ml/min, increase the pressure slowly until the display on the flow meter 414 reads about 55 ml/min (the desired flow rate). Release the force and record the flow rate. Calculate the amount of change in flow due to springback by the following formula:

Springback differential flow=recorded flow rate−55.

The springback differential flow is usually between 5 and 12 ml/min in this particular embodiment.

Calculate the compensating flow rate by the following formula:

Compensating flow rate=55−Springback differential flow.

3. Re-dimple the diffusion bonded planar manifold:

Pressing with the arbor press again, increasing the pressure slowly until the flow rate falls to the compensating flow rate. Release the arbor press and record the flow rate on the flow meter 414. This step may need to be repeated in order to reach an acceptable flow rate.

Acceptable Flow Rates

The desired flow rate is 55 ml/min. A flow rate of between 40 and 60 ml/min is acceptable for this procedure.

Figure 7A:
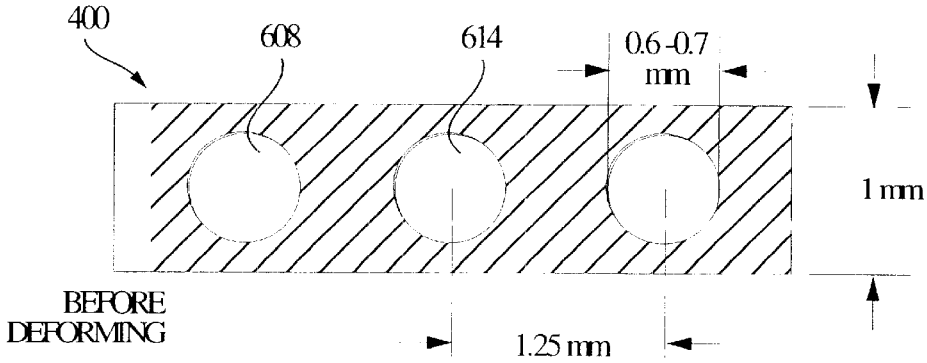
FIG. 7 is a diagram showing the restriction of a pneumatic channel during the deforming process.
Figure 7B:
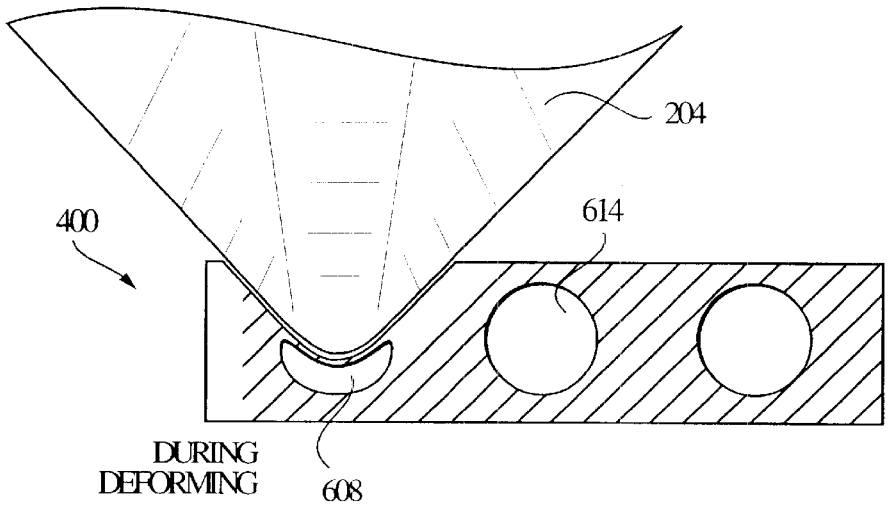
Figure 7C:
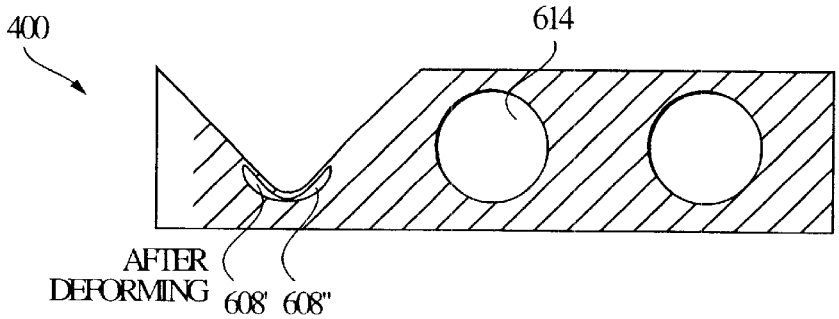

FIG. 7 demonstrates how the pneumatic channel 608 within the diffusion bonded planar manifold 400 collapses onto itself during the deforming process. The diffusion bonded planar manifold 400 used in Example 1 has a thickness of about 1 mm. The diameter of the pneumatic channels 608 and 614 within the diffusion bonded planar manifold 400 have a diameter of about 0.6 mm to about 0.7 mm. The distance between the two pneumatic channels is about 1.3 mm. When the pneumatic channel 608 is deformed by the forming pen 200, the bit 204 is pressed against the surface of the diffusion bonded planar manifold 400 above the pneumatic channel 608, causing the pneumatic channel 608 to collapse into a crest shape. When the bit 204 is pressed down further, the top of the pneumatic channel 608 reaches the bottom of the pneumatic channel 608, dividing the pneumatic channel 608 into two much smaller pneumatic channels 608'and 608" which results in a reduced fluid flow rate. The ratio between a pre-restriction flow rate and a post-restriction flow rate is defined as a "reduction rate". For example, if the flow rate in a pneumatic channel is reduced from 500 ml/min to 50 ml/min by the deforming process, the reduction rate is 10:1.

FIG. 7 also demonstrates the importance of the geometry of the bit 204 during the deforming process. When the forming pen 200 is pressed into the diffusion bonded planar manifold 400, the geometry of the bit 204 determines the extent of deformation of the targeted pneumatic channel 608 and therefore the restriction rate achieved through the deforming process. For example, a blunt bit 204 with tapering angles larger than 45° may result in a bigger dimple on the surface of the diffusion bonded planar manifold 400, leading to more restriction on the pneumatic channel 608 and possibly deformation on the neighboring pneumatic channel 614 as well. On the other hand, a sharp bit 204 with tapering angles smaller than 45° may reduce the deformed area and result in less restriction on the pneumatic channel 608.

What is claimed is:

1. An apparatus for restricting fluid flow in a pneumatic channel in a planar manifold that has a surface and one or more pneumatic channels therein, the apparatus comprising a forming pen that includes a shank and a bit at an end of the shank, wherein the bit comprises one or more side surfaces tapered inward at a tapering angle, and a tip having a size and a shape, wherein the tapering angle of the one or more side surfaces of the bit, and the size and the shape of the tip of the forming pen are configured based upon one or more of the following factors: size of the pneumatic channel to be operated upon, a position of the pneumatic channel to be operated upon relative to other pneumatic channel in the planar manifold, and a desired level of restriction of fluid flow, so that the forming pen causes the pneumatic channel to be operated upon to collapse onto itself in a controllable and predictable manner when the tip is pressed into the surface of the planar manifold.

2. The apparatus of claim 1, wherein the planar manifold is a diffusion-bonded manifold.

3. The apparatus of claim 1, wherein the tapering angle of the one or more side surfaces of the bit is between about 0° to about 75°.

4. The apparatus of claim 1, wherein the tapering angle of the one or more side surfaces of the bit is between about 30° to about 55°.

5. The apparatus of claim 1, wherein the tapering angle of the one or more side surfaces of the bit is about 45°.

6. The apparatus of claim 1, further comprising a holding device that holds the forming pen and the planar manifold, in such a position so that the bit of the forming pen is in a proximity of a surface of the planar manifold and is oriented to a centerline of the pneumatic channel to be operated upon.

7. The apparatus of claim 6, wherein the holding device comprises a pen holder for holding the forming pen, and a top compression block and a bottom compression block for holding the planar manifold.

8. The apparatus of claim 7, wherein the holding device further comprises means for connecting to a pressure regulator and means for connecting to a flow meter.

9. The apparatus of claim 8, wherein the holding device further comprises a top plate, a upper stop and a base plate.

10. The apparatus of claim 9, further comprising a pressure regulator to provide a desired flow pressure in the pneumatic channel to be operated upon, and a flow meter to monitor a flow rate in the pneumatic channel to be operated upon during a restricting process.

11. A method to restrict fluid flow in a planar manifold with one or more pneumatic channels, the method comprising:

(a) positioning a forming pen that has a bit in close proximity to a surface of the planar manifold; and (b) advancing the forming pen towards and into the planar manifold so that the bit of the forming pen deforms the surface of the planar manifold, in order to restrict fluid flow in one of the pneumatic channels to a desired reduction rate, without affecting fluid flow in other pneumatic channels and without affecting the integrity of the pneumatic channels, wherein the desired reduction rate is 3:1 or higher.

12. The method of claim 11, wherein the planar manifold is a diffusion bonded planar manifold.

13. The method of claim 11, wherein the desired reduction rate is 5:1 or higher.

14. The method of claim 11, wherein the desired reduction rate is 10:1 or higher.

15. The method of claim 11, further comprising:

(c) monitoring a flow rate in the restricted pneumatic channel with a regulated air supply and a flow meter showing a flow rate reading;

(d) retracting the forming pen when the flow rate reading is a desired flow rate.

16. The method of claim 15, further comprising:

(e) recording the flow rate reading after the retraction of the forming pen; if the recorded flow rate reading is higher than the desired flow rate;

(f) calculating a springback differential flow using the following formula:

springback differential flow=recorded flow rate reading−desired flow rate;

(g) calculating a compensating flow rate using the following formula:

compensating flow rate=the desired flow rate−springback differential flow;

(h) advancing the forming pen again until the flow rate reading is the compensating flow rate;

(i) retracting the forming pen and recording a final flow rate;

(j) validating that the final flow rate is within a tolerable range of the desired flow rate.

17. A method to restrict fluid flow in a planar manifold with one or more pneumatic channels, the method comprising:

recording a flow rate in a targeted pneumatic channel with the flow meter;

pressing a forming pen onto the planar manifold;

observing the flow rate drop in the targeted pneumatic channel;

retracting the forming pen when the flow rate in the targeted pneumatic channel is a desired flow rate;

recording the flow rate in the targeted pneumatic channel after the retraction of the forming pen.

18. The method of claim 17, further comprising:

calculating a springback differential flow and a compensating flow rate by the following formula:

springback differential flow=recorded flow rate−the desired flow rate, compensating flow rate=the desired flow rate−springback differential flow.

19. The method of claim 18, further comprising:

pressing the forming pen into the planar manifold again until the flow rate in the targeted pneumatic channel is the compensating flow rate; and retracting the forming pen to validate that a final measured flow rate is within a tolerable range of the desired flow rate.

20. A method of claim 17, further comprising:

positioning the forming pen and the diffusion bonded planar manifold in a holding device;

connecting a regulated air supply and a flow meter to the holding device;

providing an air pressure in the targeted pneumatic channel with the regulated air supply.

* * * * *